US006647232B2

(12) United States Patent
Suzuki

(10) Patent No.: US 6,647,232 B2
(45) Date of Patent: Nov. 11, 2003

(54) IMAGE FORMING APPARATUS WITH MULTIPLE DEVELOPING DEVICE ASSEMBLIES

(75) Inventor: Atsushi Suzuki, Shizuoka-ken (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/058,608

(22) Filed: Jan. 28, 2002

(65) Prior Publication Data

US 2003/0142995 A1 Jul. 31, 2003

(51) Int. Cl.[7] ..... G03G 15/01
(52) U.S. Cl. ..... 399/227; 399/298; 399/302
(58) Field of Search ..... 399/226–228, 399/298, 302

(56) References Cited

U.S. PATENT DOCUMENTS 4,792,825 A 12/1988 Saito et al.
4,922,301 A 5/1990 Katoh et al.
6,327,450 B1 * 12/2001 Ito ..... 399/227

FOREIGN PATENT DOCUMENTS

JP 10-274870 10/1998
JP 2000-347476 12/2000

* cited by examiner

*Primary Examiner*—William J. Royer
(74) *Attorney, Agent, or Firm*—Frishauf, Holtz, Goodman & Chick, P.C.

(57) ABSTRACT

An image forming apparatus including a plurality of developing devices, a plurality of developing device assemblies, and a controller. At least one developing device is provided for each type of toner to form multi-color images. Each developing device assembly carries a plurality of developing devices. The controller switches the developing devices carried by one of the developing device assemblies, while the developing devices carried by another developing device assembly are operating.

18 Claims, 5 Drawing Sheets

IMAGE FORMING APPARATUS WITH MULTIPLE DEVELOPING DEVICE ASSEMBLIES

BACKGROUND OF THE INVENTION

1. Field of the Invention

The present invention relates to an image forming apparatus to which electrophotography is applied and which uses a plurality of developing devices by switching one to another.

2. Description of the Related Art

Generally, image forming apparatuses to which electrophotography is applied comprise a photosensitive member, a charging device, an exposing device, a developing device, a transfer device and a fixing Device. Especially, a multi-color image forming apparatus for forming a multi-color image comprises a plurality of developing devices. The developing devices have toner containers, respectively, which store toners of different colors, to thereby form multi-color images. As the developing devices are switched from one to another in sequence, toner images that correspond to the color of the toner which is contained in respective toner containers, are formed on the surface of the photosensitive member. Since the toner images are laid, one upon another, a multi-color image is formed on the surface of a recording sheet.

There is a type of a multi-color image forming apparatus comprising a developing device assembly that has developing devices bundled together. The multi-color image forming apparatus switches one developing device to another by making the developing device assembly rotate like the cylinder of a revolver. The multi-color image forming apparatus repeats the image forming routine, each time carrying out charging, exposing, developing and transferring for the photosensitive member. Thus, the apparatus forms a multi-color image on the surface of a recording sheet. The multi-color image forming apparatus needs a longer time to form a complete multi-color image than a single color image forming apparatus needs to form an image, because it repeats the image forming routine as many times as sorts of color it uses.

Recently, as the demand for multi-color image forming apparatuses has increased, users now request multi-color image forming apparatuses that can form multi-color images quickly. There is one of the known techniques for forming multi-color images quickly, which raise the rotational speed at which the developing device assembly rotates to switch one developing device to another quickly. In this method, the inertia of the developing device assembly affects the rotation of the assembly, at the start and stop of rotation. A drive unit that rotates at high speed and has a large torque must be used to rotate the developing device assembly, against the inertia. In the multi-color image forming apparatus, each developing device of the developing device assembly, that is rotating, must be stopped at a predetermined position, with respect to the photosensitive member.

There is a method that is available for reducing the influence of inertia. In this method, reducing the storage capacity of each toner container decreases the weight of each developing device. However it is uneconomical, because the toner container must be replaced very often, when the storage capacity of the toner container is decreased.

The capacity of the drive device and the storage capacity of the toner containers therefore limit the increase in the rotation speed of the developing device assembly. There is a limit for the image forming speed of an image forming apparatus that switches and uses a plurality of developing devices.

BRIEF SUMMARY OF THE INVENTION

An image forming apparatus according to the present invention is designed to form images at an increased speed.

The image forming apparatus according to one embodiment of the present invention includes a plurality of developing devices, a plurality of developing device assemblies, and a controller. At least one developing device is provided for each of toners of different sorts, prepared to form an image. Each of the developing device assemblies has a plurality of developing devices. While the developing devices of one developing device assembly are operating, the controller switches developing devices of another developing device assembly, from one to another.

An image forming apparatus according to another embodiment of the invention includes a plurality of developing devices, a first developing device assembly, a second developing device assembly and a controller. At least one developing device is provided for each of the toners of different colors, prepared to form an image. The first developing device assembly has a plurality of developing devices containing toner of at least one of a plurality of colors. When the first developing device assembly is rotated, its developing devices are switched, from one to another. The second developing device assembly has a plurality of developing devices containing toners other than the toners contained in the developing devices of the first developing device assembly. When the second developing device assembly is rotated, its developing devices are switched, from one to another. While any one of the developing devices of the first developing device assembly is being driven for developing operation, the controller switches the developing device of the second developing device assembly, from one to another. Conversely, while any one of the developing devices of the second developing device assembly is being driven for developing operation, the controller switches the developing device of the first developing device assembly, from one to another.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWINGS

The accompanying drawings, which are incorporated in and constitute a part of the specification, illustrate presently preferred embodiments of the invention, and together with the general description given above and the detailed description of the preferred embodiments given below, serves to explain the principles of the invention.

DETAILED DESCRIPTION OF THE INVENTION

Figure 1:
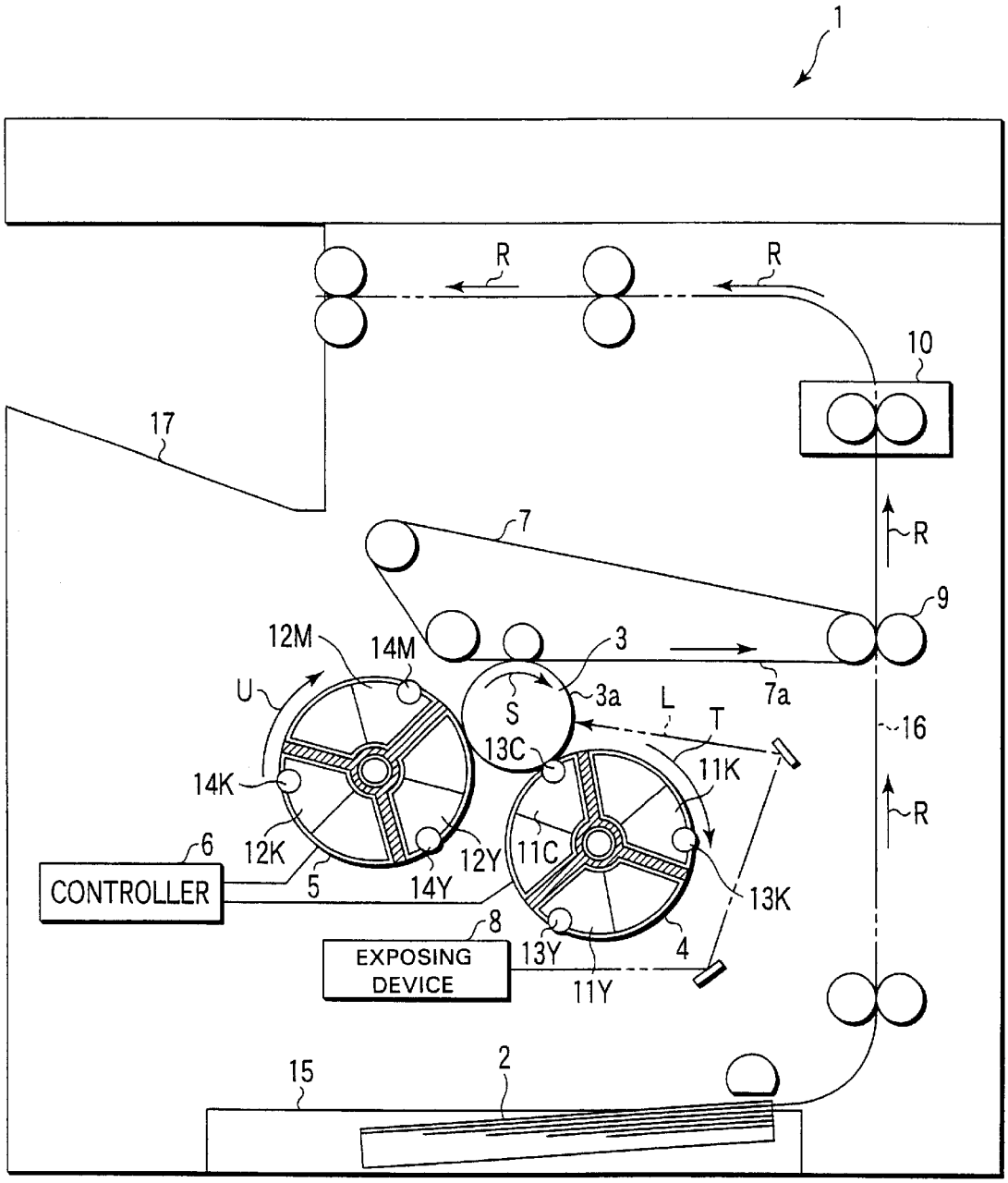
FIG. 1 is a sectional view showing, in a simplified form, an image forming apparatus according to a first embodiment of the present invention.

An image forming apparatus 1 according to a first embodiment of the present invention will be described, with reference to FIGS. 1 to 5. The image forming apparatus 1 forms a multi-color image on a recording sheet 2 by applying electro-photography. The image forming apparatus 1 comprises a photosensitive drum 3 used as a photosensitive member, a first developing device assembly 4, a second developing device assembly 5, a controller 6, an intermediate transfer belt 7, a charging device, an exposing device 8, a transfer roller 9 and a fixing device 10.

As FIG. 1 shows, the photosensitive drum 3, the first and second developing device assemblies 4 and 5, and intermediate transfer belt 7 are arranged, with their axes of rotation run extending parallel to each other and perpendicular to the cross section of FIG. 1. The charging device (not shown) electrically charges the photosensitive drum 3. When the photosensitive drum 3 electrically charged is exposed to light L emitted from the exposing device 8, an invisible electrostatic latent image is formed on the surface 3*a* of the photosensitive drum 3.

The first developing device assembly 4 has a plurality of developing devices containing respective toners of different colors to be used for forming multi-color images. For example, it has a cyan developing device 11C containing cyan toner, a yellow developing device 11Y containing yellow toner and a black developing device 11K containing black toner in this embodiment. The second developing device assembly 5 has a plurality of developing devices containing respective toners of different colors to be used for forming multi-color images. For example, it has a magenta developing device 12M containing magenta toner, a black developing device 12K containing black toner and a yellow developing device 12Y containing yellow toner in this embodiment. The first developing device assembly 4 is arranged upstream of the second developing device assembly 5, with respect to the direction indicated by arrow S in FIG. 1, in which the photosensitive drum 3 is rotated.

As the controller 6 rotates and stops first developing device assembly 4 and the second developing device assembly 5, the developing devices 11C, 11Y, 11K, 12M, 12K and 12Y mounted on the first and second developing device assemblies 4 and 5 are switched from one to another. The controller 6 switches the developing devices 12M, 12K and 12Y of the second developing device assembly 5, while the developing devices 11C, 11Y and 11K of the first developing device assembly 4 are operating. Similarly, the controller 6 switches the developing device 11C, 11Y and 11K of the first developing device assembly 4, while the developing devices 12M, 12K and 12Y of the second developing device assembly 5 are operating. This is one of the orders for layering different colors one upon another. For example, a cyan layer, a magenta layer, a yellow layer and a black layer may be laid in the order mentioned. In this case, the controller 6 controls the first developing device assembly 4 and the second developing device assembly 5 so that the cyan developing device 11C, magenta developing device 12M, yellow developing device 11Y and black developing device 12K may sequentially operate in the order they are mentioned. When the yellow developing device 11Y of the first developing device assembly 4 becomes short of toner, the controller 6 uses the yellow developing device 12Y of the second developing device assembly 6. When the black developing device 12K of the second developing device assembly 5 becomes short of toner, the controller 6 uses the black developing device 11K of the first developing device assembly 4.

The developing devices 11C, 11Y, 11K, 12M, 12K and 12Y have developing rollers 13C, 13Y 13K, 14M, 14K and 14Y, respectively, which supply toner to the photosensitive drum 3. A toner image is formed on the surface 3*a* of the photosensitive drum 3 as the electric latent image formed on the surface 3*a* electrostatically attracts the toner. The toner forms a toner image on the surface 3*a* of the photosensitive drum 3, on which the electrostatic latent image exists. The toner images formed by the developing devices 11C, 11Y, 11K, 12M, 12K and 12Y are transferred from the photosensitive drum 3 onto the surface 7*a* of the intermediate transfer belt 7.

The intermediate transfer belt 7 is arranged to contact rotationally with the photosensitive drum 3 and also on the recording sheet 2. The toner images formed by the developing devices 11C, 11Y, 11K, 12M, 12K and 12Y are sequentially transferred from the photosensitive drum 3 to the surface 7*a* of the intermediate transfer belt 7 and are laid one upon,another, on the surface 7*a*. The rotation of the photosensitive drum 3 and that of the intermediate transfer belt 7 are synchronized to form a complete multi-color image on the surface 7*a* of the intermediate transfer belt 7, by sequentially laying the toner images one upon another.

The transfer roller 9 transfers the multi-color toner image from the surface 7*a* of the intermediate transfer belt 7 onto the recording sheet 2 that has been conveyed from cassette 15 along a conveying route 16 in the direction of arrow R. The recording sheet 2 with the multi-color toner image transferred on it is moved further in the direction of arrow R. The multi-colored toner image is fixed in the fixing device 10. Thereafter, the recording sheet 2 is delivered to stack-area 17 located outside the image forming apparatus 1.

Figure 2:
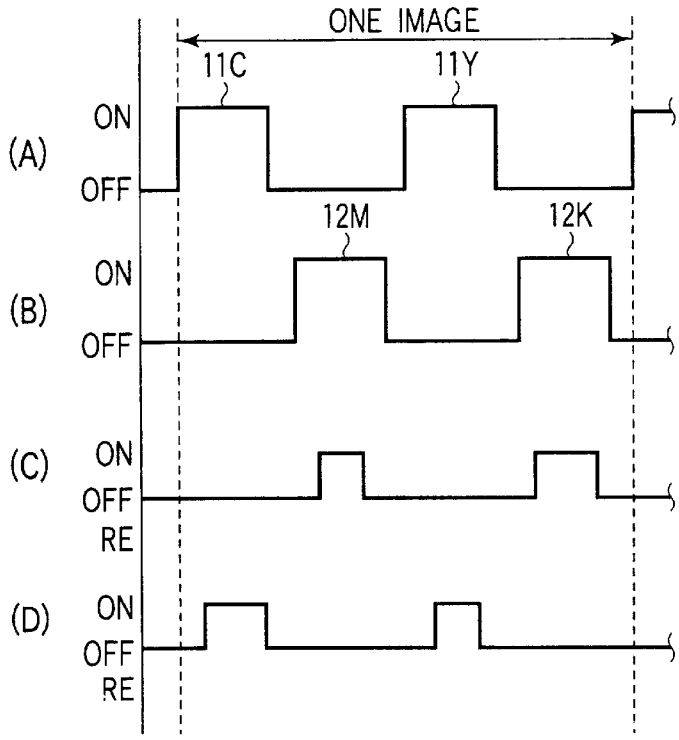
FIG. 2 is a timing chart illustrating how developing device assemblies shown in FIG. 1 operate as time passes.
Figure 3:
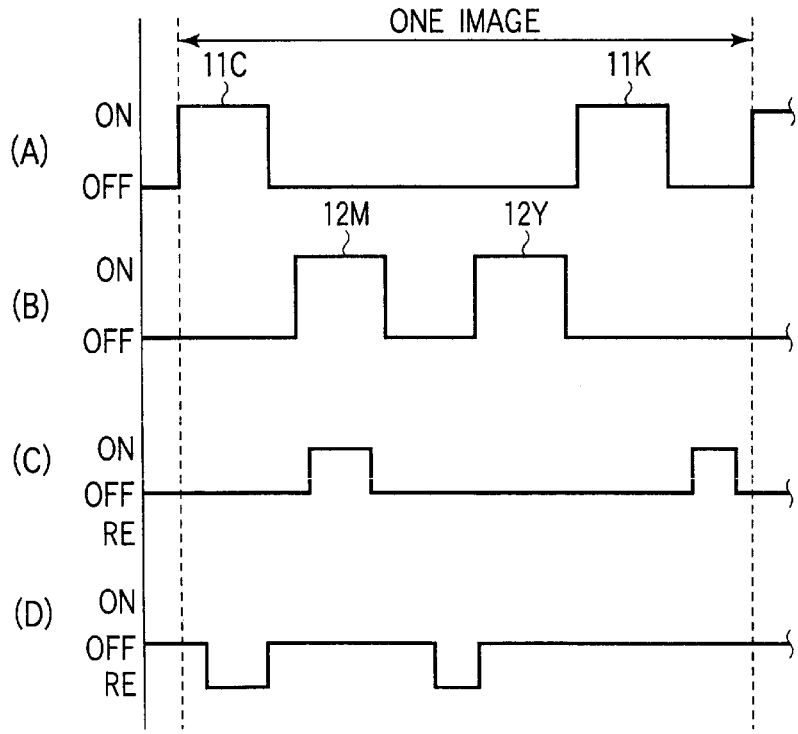
FIG. 3 is a timing chart showing how developing device assemblies of FIG. 1 operate as time passes, when a yellow developing device of a first developing device assembly is short of toner or when a black developing device of a second developing device assembly is short of toner.
Figure 4:
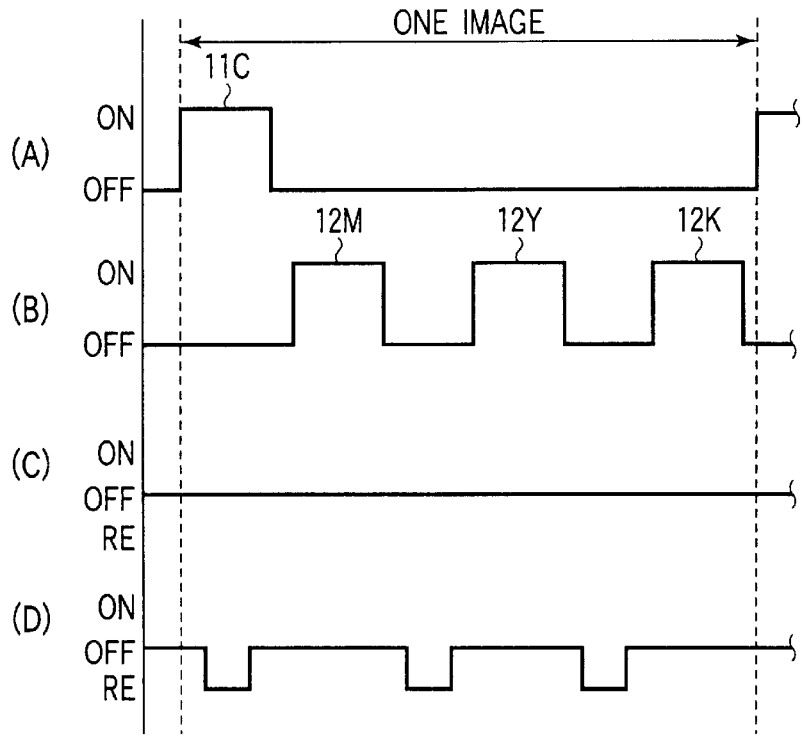
FIG. 4 is a timing chart explaining how developing device assemblies of FIG. 1 operate as time passes, when both a yellow developing device and a black developing device of a first developing device assembly are short of toner.
Figure 5:
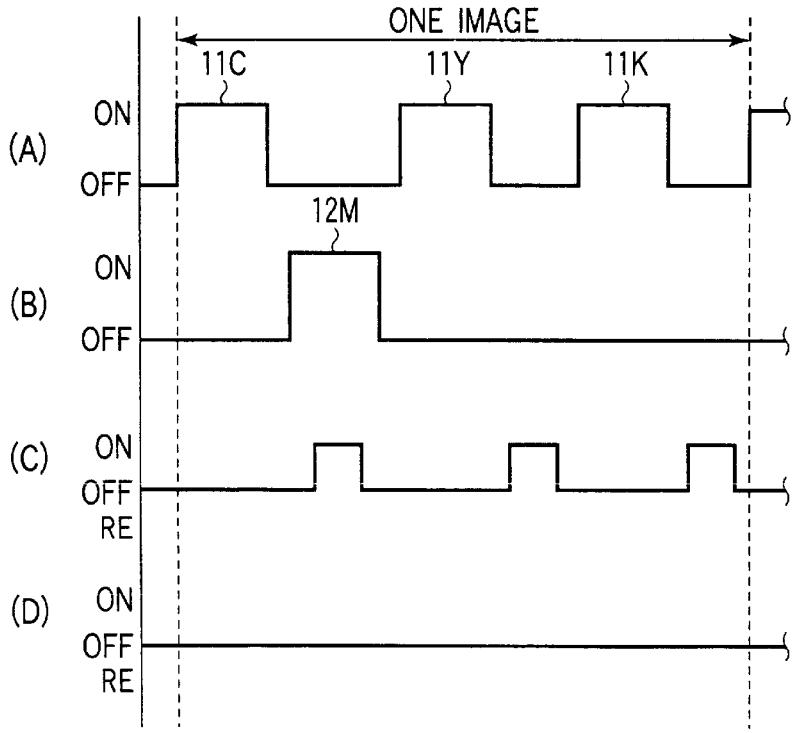
FIG. 5 is a timing chart showing how developing device assemblies of FIG. 1 operate as time passes, when both a yellow developing device and a black developing device of a second developing device assembly are short of toner.

A cycle of forming a multi-color image, performed by the developing devices of the first and second developing device assemblies 4 and 5, will be described, with reference to FIGS. 2 to 5. FIG. 2 shows operating conditions for each part when the yellow developing device 11Y of the first developing device assembly 4 and the black developing device 12K of the second developing device assembly 5 contain a sufficient amount of toner. FIG. 3 shows operating conditions for each part when the yellow developing device 11Y of the first developing device assembly 4 is short of toner or when the black developing device 12K of the second developing device assembly 5 is short of toner. FIG. 4 shows operating conditions for each part when both the yellow developing device 11Y and the black developing device 11K of the first developing device assembly 4 are short of toner. FIG. 5 shows operating conditions for each part when both the black developing device 12K and the yellow developing device 12Y of the second developing device assembly 5 are short of toner. (A) in FIGS. 2 to 5 illustrates conditions of the developing devices 11C, 11Y and 11K of the first developing device assembly 4; ON indicates that the developing devices are active, whereas OFF indicates that the developing devices are inactive. (B) in FIGS. 2 to 5 illustrates conditions of the developing devices 12M, 12K and 12Y of the second developing device assembly 5; ON indicates that the developing devices are active, whereas OFF indicates that the developing devices are inactive. (C) in FIGS. 2 to 5 illustrates the rotation of the first developing device assembly 4. At (C), ON indicates that the first developing device assembly 4 is rotating forwards in the direction of arrow T in FIG. 1, OFF indicates that the first developing device assembly 4 is at a halt, and RE indicates that the first developing device assembly 4 is rotating in the direction opposite to arrow T in FIG. 1. (D) in FIGS. 2 to 5 illustrates the rotation of the second developing device assembly 5. At (D), ON indicates that the second developing device assembly 5 is rotating forwards in the direction of arrow U in FIG. 1, OFF indicates that the second developing device assembly 5 is at a stop, and RE indicates that the second developing device assembly 5 is rotating in the direction opposite to arrow U in FIG. 1. In the timing charts of FIGS. 2 to 5, the sizes of the signals in (C) and (D) represent the angles of rotation of the first and second developing device assemblies 4 and 5. For example, the first signal at (C) of FIG. 2 shows that the first developing device assembly 4 rotates by ⅓ of a full turn to switch the developing devices, from the cyan developing device 11C to the yellow developing device 11Y; the second signal at (C) of FIG. 2, larger than the first signal, shows that the first developing device assembly 4 rotates by ⅔ of a full turn to switch the developing devices, the yellow developing device 11Y to cyan developing device 11C, skipping the black developing device 11K.

As FIG. 2 shows, the second developing device assembly 5 is rotated to prepare the magenta developing device 12M for developing immediately, while the cyan developing device 11C of the first developing device assembly 4 is operating. While the magenta developing device 12M is operating, the first developing device assembly 4 is rotated to prepare the yellow developing device 11Y for developing next to magenta developing device 12M. Similarly, while the yellow developing device 11Y of the first developing device assembly 4 is operating, the second developing device assembly 5 is rotated to make the black developing device 12K ready to perform a developing operation, immediately after the yellow developing device 11Y operates. Finally, while the black developing device 12K of the second developing device assembly 5 is operating, the first developing device assembly 4 is rotated to prepare the cyan developing device 11C for the next multi-color image forming cycle, skipping the black developing device 11K of the first developing device assembly 4.

As described above, the controller 6 rotates and stops the first developing device assembly 4 and the second developing device assembly 5 in the image forming apparatus 1, so as to switch the developing devices comprised in one developing device assembly, while the developing device comprised in the other developing device assembly is operating. When the developing device of one assembly finishes the developing operation, the developing device of the other assembly can therefore immediately start the next developing operation. In other words, the image forming-apparatus 1 switches any operating developing device to another developing device that should perform the next developing operation, without the rotation of the developing device assembly. That is, the currently operating developing device can be switched to the next developing device almost instantaneously; without waiting to prepare the next developing device for operation. Thus, all time necessary for forming a multi-color image is remarkably reduced, because the standby time necessary for switching from the operating developing device to the next developing device is shorter in this embodiment than in the case where the developing device assembly must be rotated to switch the developing devices, from one to another.

In this embodiment, the image forming apparatus 1 comprises two yellow developing devices and two black developing devices. This is because yellow toner and black toner are usually consumed at high rates. The two yellow developing devices 11Y and 12Y are provided in the first developing device assembly 4 and the second developing device assembly 5, respectively. The black developing devices 11K and 12K are provided in the first developing device assembly 4 and the second developing device assembly 5, respectively.

When the yellow developing device 11Y of the first developing device assembly 4 or the black developing device 12K of the second developing device assembly 5 becomes short of toner, the controller 6 rotates and stops the first developing device assembly 4 and the second developing device assembly 5 as is illustrated in FIG. 3. At this time, the controller 6 reversibly rotates the second developing device assembly 5 in the direction opposite to arrow U in FIG. 1, in order to shorten the standby time necessary for switching the magenta developing device 12M to the yellow developing device 12Y.

As FIG. 3 shows, in this case, the cyan developing device 11C of the first developing device assembly 4, the magenta developing device 12M of the second developing device assembly 5, the yellow developing device 12Y of the second developing device assembly 5 and the black developing device 11K of the first developing device assembly 4 are driven in the order they are mentioned, in the image forming apparatus 1. When the cyan developing device 11C is switched to the magenta developing device 12M, the controller 6 makes the magenta developing device 12M ready for the developing operation before the cyan developing device 11C finishes the developing operation. When the yellow developing device 12Y is switched to the black developing device 11K, the-controller 6 makes the black developing device 11K ready for the developing operation before the yellow developing device 12Y finishes the developing operation. Therefore, the waiting time for switching from a developing device to another is shorter than in the case where the developing device assembly must switch one developing device to another with its rotational movement.

When both the yellow developing device 11Y and the black developing device 11K of the first developing device assembly 4 become short of toner, the controller 6 rotates and stops the second developing device assembly 5, as is illustrated in FIG. 4. At this time, the controller 6 does not rotate the first developing device assembly 4, because only the cyan developing device 11C is used. The controller 6 reversibly rotates the second developing device assembly 5 in the direction opposite to. arrow U in FIG. 1 in order to shorten the standby time necessary for switching the magenta developing device 12M to the yellow developing device 12Y and the standby time necessary for switching the yellow developing device 12Y to the black developing device 12K.

As FIG. 4 shows, in this case, the cyan developing device 11C of the first developing device assembly 4, the magenta developing device 12M of the second developing device assembly 5, the yellow developing device 12Y of the second developing device assembly 5 and the black developing device 12K of the second developing device assembly 5 are driven in the order they are mentioned, in the image forming apparatus 1. When the cyan developing device 11C is switched to the magenta developing device 12M, the controller 6 makes the magenta developing device 12M ready for the developing operation before the cyan developing device 11C finishes the developing operation. As the cyan developing device 11C is switched to the magenta developing device 12M without rotational movement of the developing device assembly 4, the waiting time for switching one developing device to another is shorter than in the case where the developing device assembly must switch, while rotating, one developing device to another. As the first developing device assembly 4 is not rotated, the waiting time for switching the black developing device 12K to the cyan developing device 11C is shorter than in the method wherein the developing device assembly must switch, while rotating, one developing device to another, when the multi-color images are formed consecutively. When the yellow developing device 11Y of the first developing device assembly 4 becomes short of toner, the developing devices may be operated as shown in FIG. 4, in the image forming apparatus 1. When both the black developing device 12K and the yellow developing device 12Y of the second developing device assembly 5 become short of toner, the controller 6 rotates the first developing device assembly 4 and stops the same as is illustrated in FIG. 5. In this case, the controller 6 does not rotate the second developing device assembly 5, because only the magenta developing device 12M is used. Therefore, the waiting time for switching the developing devices is shorter than in the method wherein the developing device assembly switches, while rotating, one developing device to another, because no developing device assemblies need to be rotated, when the cyan developing device 11C is switched to the magenta developing device 12M. When the magenta developing device 12M is switched to the yellow developing device 11Y, the controller 6 makes the yellow developing device 11Y ready for developing operation before the magenta developing device 12M finishes the developing operation. Therefore, the waiting time for switching one developing device to another is shorter than in a method wherein the developing device assembly must switch, while rotating, one developing device to another, because the magenta developing device 12M is switched to the yellow developing device 11Y without rotational movement of any developing device assembly. When the black developing device 12K of the second developing device assembly 5 becomes short of toner, the developing devices may be driven as shown in FIG. 5, in the image forming apparatus 1.

An image forming apparatus 1 of a second embodiment according to the present invention will be described by referring to FIGS. 6 and 7. The components that are the same as the image forming apparatus 1 according to the first embodiment will respectively apply the same reference symbols.

Figure 6:
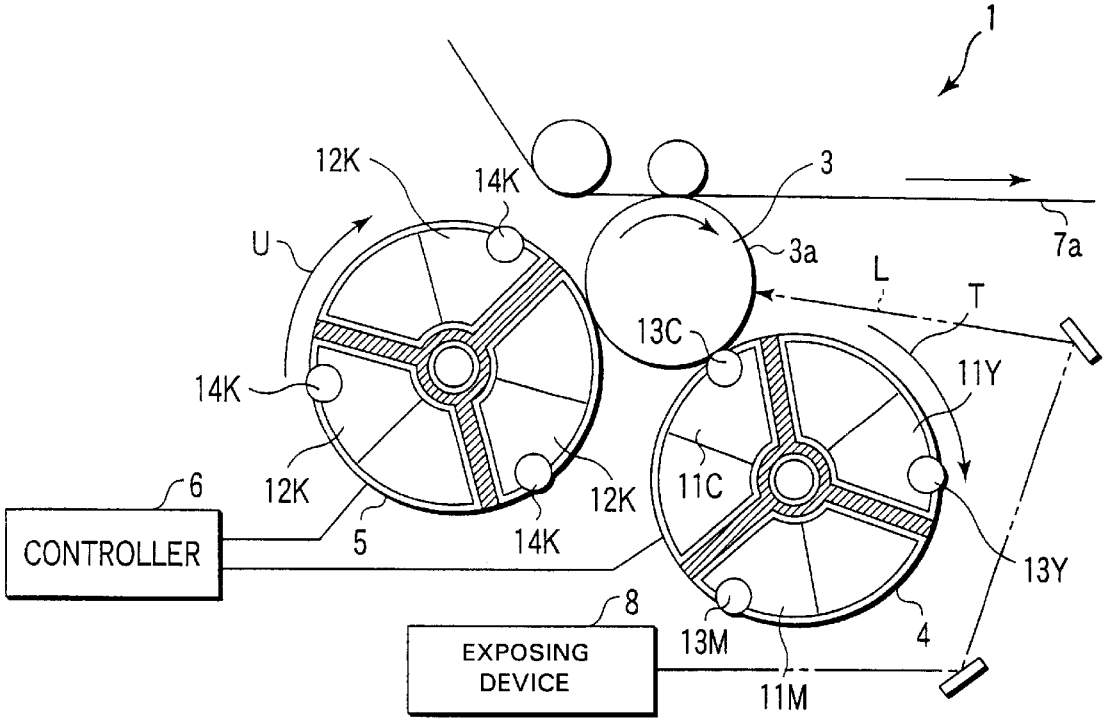
FIG. 6 is a simplified sectional view of a first developing device assembly, a second developing device assembly and the vicinity thereof in an image forming apparatus that is a second embodiment of the present invention.

FIG. 6 is a simplified schematic sectional view of a first developing device assembly 4, a second developing device assembly 5 and the vicinity thereof of the image forming apparatus 1. The first developing device assembly 4 has a cyan developing device 11C, a magenta developing device 11M, and a yellow developing device 11Y. The second developing device assembly 5 has three black developing devices 12K. A controller 6 controls the first developing device assembly 4 and the second developing device assembly 5 so that developing operations may be sequentially performed for cyan, magenta, yellow and black.

Figure 7:
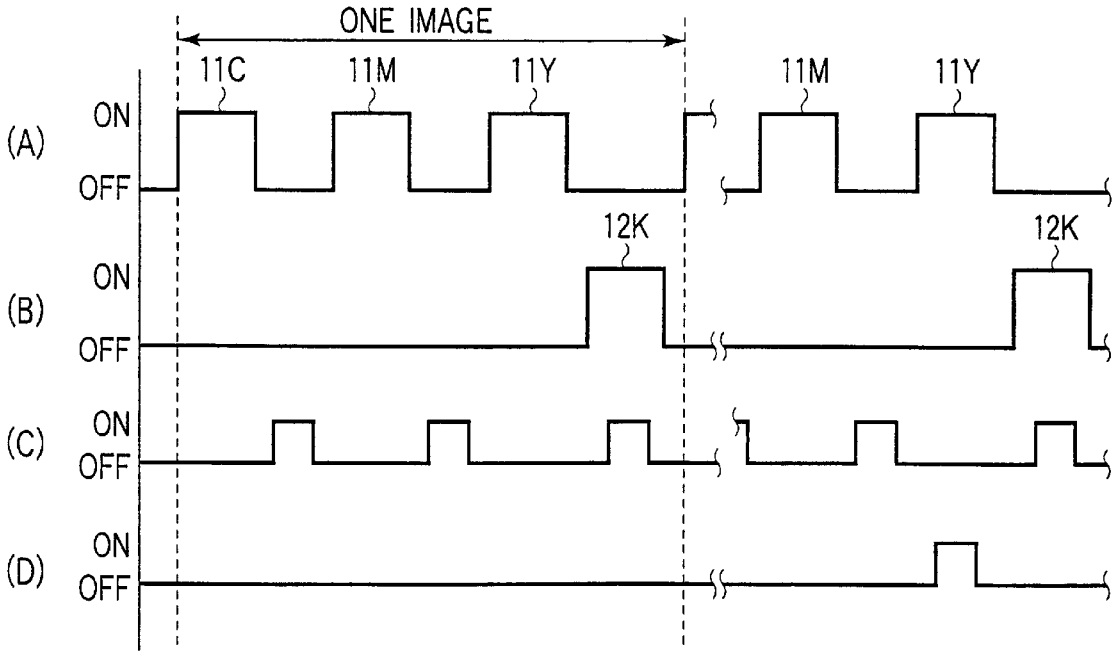
FIG. 7 is a timing chart explaining how developing device assemblies of FIG. 6 operate as time passes, when the two assemblies are used in combination.

FIG. 7 shows the operations of the first and second developing device assemblies 4 and 5, and the developing devices 11C, 11M, 11Y and 12K. (A) in FIG. 7 illustrates the operations of the developing devices 11C, 11M, 11Y of the first developing device assembly 4. At (A), ON indicates that the developing devices are active, whereas OFF indicates that the developing devices are inactive. (B) in FIG. 7 shows the operations of the developing devices 12K of the second developing device assembly 5. At (B), ON indicates that the developing devices are active, whereas OFF indicates that the developing devices are inactive. (C) in FIG. 7 shows how the first developing device assembly 4 is rotated. At (C), ON indicates that the first developing device assembly 4 is rotating forwards in the direction of arrow T in FIG. 6, and OFF indicates that the first developing device assembly 4 is at a stop. (D) in FIG. 7 shows how the second developing device assembly 5 is rotated. At (D), ON indicates that the second developing device assembly 5 is rotating forwards in the direction of arrow U in FIG. 6, and OFF indicates that the second developing-device assembly 5 is at a stop.

The image forming apparatus conducts a developing operation at the yellow developing device 11Y of the first developing device assembly 4, and then conducts a developing operation at the black developing device 12K of the second developing device assembly 5. The time for switching developing devices is shorter than in a method wherein the developing device assembly is switched, while rotating, one developing device to another, because the yellow developing device 11Y is switched to the black developing device 12K without rotational movement of any developing device assemblies. Additionally, when multi-color images are formed consecutively, the cyan developing device 11C of the first developing device assembly 4 is prepared for a developing operation, while the black developing device 12K performs a developing operation. Therefore, the time for switching the developing devices is shorter than in a method wherein the developing device assembly must switch, while rotating, one developing device to another, because the black developing device 12K is switched to the cyan developing device 11C without rotational movement of any developing device assemblies.

Black toner is usually consumed at a rate higher than any other toner. The image forming apparatus 1 comprises three developing devices 12K containing black toner. When the first black developing device 12K becomes short of toner, the controller 6 rotates the second developing device assembly 5 and switches the first black developing device 12K to the next black developing device 12K by the time the second black developing device 12K must operate. Thus, the image forming operation can be continued without intervention of the user and, hence, without suspension of the automatic image forming operation.

An image forming apparatus 1 of a third embodiment according to the present invention will be described, with reference to FIGS. 8 and 9. The components that are the same as the image forming apparatuses 1 according to the first and second embodiments will respectively apply the same reference symbols.

Figure 8:
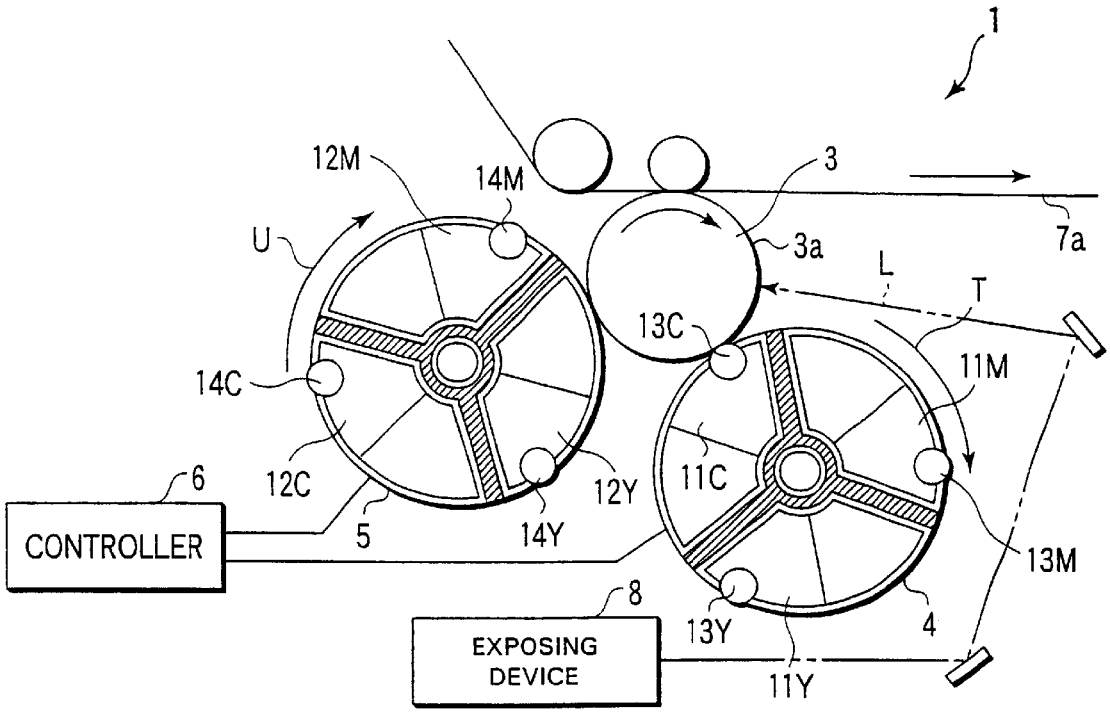
FIG. 8 is a simplified cross sectional view of a first developing device assembly, a second developing device assembly and the vicinity thereof in an image forming apparatus that is a third embodiment of the invention.

FIG. 8 is a simplified sectional view of a first developing device assembly 4, a second developing device assembly 5 and in the vicinity thereof, in the image forming apparatus 1. The first developing device assembly 4 has a cyan developing device 11C, a magenta developing device 11M and a yellow developing device 11Y. The second developing device assembly 5 has a cyan developing device 12C, a magenta developing device 12M and a yellow developing device 12Y. The image forming apparatus 1 forms a multi-color image by using cyan toner, magenta toner and yellow toner.

Figure 9:
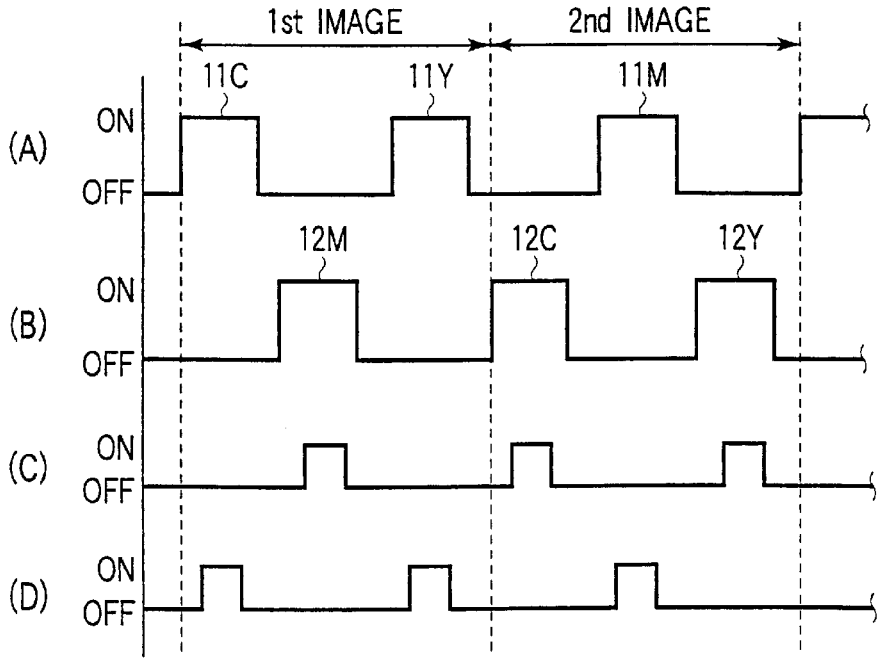
FIG. 9 is a timing chart explaining how developing device assemblies of FIG. 8 operate as time passes, when the two assemblies are used in combination.

FIG. 9 is a timing chart explaining how the first and second developing device assemblies 4 and 5 and their developing devices 11C, 11M, 11Y, 12C, 12M, 12Y operate as time passes. (A) in FIG. 9 shows operating states of the developing devices 11C, 11M and 11Y of the first developing device assembly 4; ON means the active state and OFF means the inactive state. (B) in FIG. 9 illustrates operating states of the developing devices 12C, 12M and 12Y of the second developing device assembly 5; ON means the active state and OFF means the inactive state. (C) in FIG. 9 shows the operating state of the first developing device assembly 4. At (C), ON means that the first developing device assembly 4 is rotating forwards in the direction of arrow T in FIG. 8, and OFF means that the first developing device assembly 4 is at a stop. (D) in FIG. 9 shows the operating state of the second developing device assembly 5. At(D), ON means that the second developing device assembly 5 is rotating forwards in the direction of arrow U in FIG. 8, and OFF means that the second developing device assembly 5 is at a stop.

The multi-color images are formed by using the cyan developing device, magenta developing device and yellow developing device in the order they are mentioned. The image forming apparatus 1 forms a first multi-color image by using the cyan developing device 11C of the first developing device assembly 4, the magenta developing device 12M of the second developing device assembly 5, and the yellow developing device 11Y of the first developing device assembly 4 sequentially in the order they are mentioned, and then forms a second multi-color image using the cyan developing device 12C of the second developing device assembly 5, the magenta developing device 11M of the first developing device assembly 4, and the yellow developing device 12Y of the second developing device assembly 5 sequentially in the order they are mentioned, as shown in FIG. 9.

As FIG. 9 shows, while the cyan developing device 11C of the first developing device assembly 4 is performing the developing operation, the yellow developing device 12Y of the second developing device assembly 5 is switched to the magenta developing device 12M. While the magenta developing device 12M of the second developing device assembly 5 is performing the developing operation, the cyan developing device 11C of the first developing device assembly 4 is switched to the yellow developing device 11Y. While the yellow developing device 11Y of the first developing device assembly 4 is performing the developing operation, the magenta developing device 12M of the second developing device assembly 5 is switched to the cyan developing device 12C. While the cyan developing device 12C of the second developing device assembly 5 is performing the developing operation, the yellow developing device 11Y of the first developing device assembly 4 is switched to the magenta developing device 11M. While the magenta developing device 11M of the first developing device assembly 4 is performing the developing operation, the cyan developing device 12C of the second developing device assembly 5 is switched to the yellow developing device 12Y. While the yellow developing device 12Y of the second developing device assembly 5 is performing the developing operation, the magenta developing device 11M of the first developing device assembly 4 is switched to the cyan developing device 11C.

The developing device to be used next is mounted on the developing device assembly different from the developing device assembly carrying the developing device that is performing the developing operation. While one developing device is performing the developing operation, the next developing device to operate is prepared for the developing operation by rotation of the other developing device assembly. Therefore, the waiting time is shortened to switch the developing devices, because the developing device that operates is switched to the next developing device without the rotational movement of any developing device assemblies.

In the image forming apparatuses 1 according to the first, second and third embodiments, the cyan developing devices 11C and 12C, magenta developing devices 11M and 12M, yellow developing devices 11Y and 12Y and black developing devices 11K and 12K are identical in configuration. Thus, it is easy to modify the combination of the developing devices which are carried on the first and second developing device assemblies 4 and 5, e.g., the plural developing devices, which contain the toner consumed at a high rate, are carried on the developing device assemblies as the black developing devices 11K and 12K and the yellow developing devices 11Y and 12Y in the image forming apparatus 1 according to the first embodiment. Since the developing devices have the same configuration, they can be composed of common parts. To enhance the quality of the multi-color image, one or more developing devices, each containing toner of an intermediate color or halftone color, may be mounted on each assembly, in addition to those each containing cyan, magenta, yellow or black toner.

Two or more developing device assemblies may be comprised in the image forming apparatus. Each of the developing device assemblies may have two, four or more developing devices.

In the image forming apparatus according to each embodiment, the cyan developing device, magenta developing device, yellow developing device and black developing device are used in the order mentioned, to form a multi-color image. Nonetheless, they may be used in any other order.

A plurality of developing devices containing toners of different gray gradations may be carried on the first developing device assembly and a plurality of developing devices containing toners of other different gray gradations different from those contained in the developing devices of the first developing device assembly may be carried on the second developing device assembly, instead of the cyan developing devices, magenta developing devices, yellow developing devices, and black developing devices. In this case, it is possible to form monochromatic images presenting smoothly changing gradation, within a short period of time.

Additional advantages and modifications will readily occur to those skilled in the art. Therefore, the invention in its broader aspects is not limited to the specific details and representative embodiments shown and described herein.

Accordingly, various modifications may be made without departing from the spirit or scope of the general inventive concept as defined by the appended claims and their equivalents.

What is claimed is:

1. An image forming apparatus comprising:

a plurality of developing devices containing different colors of toners for forming an image, at least one developing device provided for each color of toner;

a plurality of developing device assemblies carrying the developing devices, respectively, and switching the developing devices to others when rotated; and a controller which switches the developing devices carried by one of the developing device assemblies, while the developing devices carried by another developing device assembly are operating.

2. An image forming apparatus according to claim 1, wherein the controller rotates and stops one developing device assembly carrying the developing devices to perform a developing operation next, thus making the developing devices ready to operate, before a preceding developing device performing a developing operation finishes a developing operation, when the developing devices are switched from said preceding developing device to a subsequent developing device carried by the developing device assembly that is different from the developing device assembly carrying said preceding developing device.

3. An image forming apparatus according to claim 1, wherein the different colors of toners include cyan, yellow and magenta toners.

4. An image forming apparatus according to claim 3, wherein each of the developing device assemblies carries cyan developing devices containing cyan toner, magenta developing devices containing magenta toner and yellow developing devices containing yellow toner, and said controller switches the developing device carried by one of the developing device assemblies to the developing device carried by another of said developing device assemblies, thereby to cause the cyan developing devices, the magenta developing devices and the yellow developing devices to perform developing operations sequentially in the order mentioned.

5. An image forming apparatus according to claim 1, wherein the different colors of toners include cyan, yellow, magenta and black toners.

6. An image forming apparatus according to claim 5, wherein a plurality of yellow developing devices containing yellow toner and a plurality of black developing devices containing black toner are provided.

7. An image forming apparatus according to claim 6, wherein each of the developing device assemblies carries a yellow developing device and a black developing device.

8. An image forming apparatus comprising:

a plurality of developing devices for containing toners of different colors for forming a multi-color image, at least one developing device being provided for toner of each color;

a first developing device assembly which carries a plurality of developing devices containing toners of at least one of the colors and which switches one developing device to another when rotated;

a second developing device assembly which carries a plurality of developing devices containing toners of the colors other than said at least one of the colors included in the first developing device assembly and, which switches one developing device to another when rotated; and a controller which switches developing devices carried by the second developing device assembly while the developing devices carried by the first developing device assembly are operating, and which switches the developing devices carried by the first developing device assembly while the developing devices carried by the second developing device assembly are operating.

9. An image forming apparatus according to claim 8, wherein said developing devices include a cyan developing device containing cyan toner, a magenta developing device containing magenta toner, and a yellow developing device containing yellow toner.

10. An image forming apparatus according to claim 9, wherein the controller switches the developing devices, in the order of a cyan developing device, a magenta developing device and a yellow developing device.

11. An image forming apparatus according to claim 8, wherein each of said first developing device assembly and said second developing device assembly carries at least a cyan developing device containing cyan toner, a magenta developing device containing magenta toner, and a yellow developing device containing yellow toner.

12. An image forming apparatus according to claim 8, wherein the developing devices include a cyan developing device containing cyan toner, a magenta developing device containing magenta toner, a yellow developing device containing yellow toner and a black developing devices containing black toner.

13. An image forming apparatus according to claim 12, wherein the controller switches the developing devices, in the order of a cyan developing device, a magenta developing device, a yellow developing device and a black developing device.

14. An image forming apparatus according to claim 8, wherein the first developing device assembly supports at least one cyan developing device containing cyan toner and at least one yellow developing device containing yellow toner, and the second developing device assembly supports at least one magenta developing device containing magenta toner and at least one black developing device containing black toner.

15. An image forming apparatus according to claim 14, wherein the first developing device assembly further carries a black developing device.

16. An image forming apparatus according to claim 15, wherein the black developing device carried by said first developing device assembly is used when the black developing device carried by said second developing device assembly falls short of toner.

17. An image forming apparatus according to claim 14, wherein the second developing device assembly further carries a yellow developing device.

18. An image forming apparatus according to claim 17, wherein the yellow developing device carried by said second developing device assembly is used when the yellow developing device carried by said first developing device assembly falls short of toner.

* * * * *